US006497493B1

(12) United States Patent
Theisen

(10) Patent No.: US 6,497,493 B1
(45) Date of Patent: Dec. 24, 2002

(54) ILLUMINATED SAFETY HELMET

(75) Inventor: David A. Theisen, Hampstead, NC (US)

(73) Assignee: Marpac Corporation, Wilmington, NC (US)

( * ) Notice: Subject to any disclaimer, the term of this patent is extended or adjusted under 35 U.S.C. 154(b) by 0 days.

(21) Appl. No.: 09/850,397

(22) Filed: May 7, 2001

(51) Int. Cl.[7] ..... F21V 21/084

(52) U.S. Cl. ..... 362/105; 362/106; 362/191; 362/396; 2/422; 2/902

(58) Field of Search ..... 362/105, 106, 362/191, 396; 2/422, 902

(56) References Cited

U.S. PATENT DOCUMENTS 4,521,831 A * 6/1985 Thayer ..... 2/422
4,760,373 A 7/1988 Reilly
4,769,629 A 9/1988 Tigwell
4,862,331 A 8/1989 Hanabusa
5,313,187 A 5/1994 Choi et al.
5,658,065 A 8/1997 Jamieson
5,688,039 A 11/1997 Johnson
5,758,947 A * 6/1998 Glatt ..... 362/105
5,810,467 A 9/1998 Hurwitz
5,910,764 A 6/1999 Hayden
D424,247 S 5/2000 Deleon
6,113,244 A 9/2000 Baumgartner

* cited by examiner

*Primary Examiner*—Stephen Husar
*Assistant Examiner*—Bertrand Zeade
(74) *Attorney, Agent, or Firm*—MacCord Mason PLLC

(57) ABSTRACT

An illuminated protective headgear is described that includes a safety helmet with a molded shell adapted to fit over a user's head, the shell having a rear section; a battery-powered light mounting bracket on the rear section of the shell; and a battery-powered light including an attachment clip adapted for releasable attachment to the light mounting bracket. The light mounting bracket may be an attachable bracket that can be secured to the rear section of an existing safety helmet, or a mounting bracket that is integrally molded as a part of the rear section of the helmet shell.

16 Claims, 3 Drawing Sheets

ILLUMINATED SAFETY HELMET

BACKGROUND OF THE INVENTION (1) Field of the Invention

The present invention relates generally to a safety helmet, and in particular to a safety helmet having a battery-powered light on the rear of the helmet to identify the location of the wearer.

(2) Description of the Prior Art

Safety helmets are mandatory for use in a variety of work activities where there is a risk that objects may fall onto the wearer's head, or where the wearer may accidentally strike his or her head against a stationary object. Generally, these helmets are comprised of a molded shell of an impact resistant plastic, and an adjustable inner liner, permitting one shell size to be worn by a plurality of wearers.

The shape of the helmet shell may vary depending upon the nature of the work being performed by the wearer. Generally, safety helmet shells include a crown portion with a continuous lower edge, and an integral continuous brim that extends outwardly from the lower edge of the crown. The brim may be of a uniform width, or a portion of the brim, e.g., the front and/or rear of the brim can be elongated to provide additional protection. The construction and characteristics of safety helmets are defined by the American National Standards Institute, which sets forth various mandatory requirements. For example, the current standards ANSI Z89.1-1997, incorporated herein by reference, require that no mounting holes can be used above the static test line, which is a test line used as a boundary for conducting electrical insulation and flammability tests.

Various accessories may be attached to safety helmets to increase their utility. For example, many safety helmets include integrally molded attachment brackets at the sides of the helmet for attachment of protective ear covering. These brackets have also been used to attach a battery-powered light that points toward the front of the helmet for use by the wearer in seeing to the front. See U.S. Pat. No. 5,658,065 to Jamieson. Other specially designed battery-powered lamps or lights have been attached to the sides of a safety helmet with mounting brackets, with the lamps being adapted to swivel 360°. See U.S. Pat. No. 4,521,831 to Thayer.

However, there remains a need for a safety helmet that includes a battery-powered light that is specifically designed to be seen from the rear of the helmet by individuals other than the wearer.

SUMMARY OF THE INVENTION

Unlike prior art designs, the present invention relates to a safety helmet that includes a detachable battery-powered light that is mounted on the rear of the safety helmet. This configuration is specifically adapted to alert others to the presence of the wearer, so that the wearer will not be endangered by activities being conducted by others behind the wearer. In addition, the rear-mounted light serves as a location beacon in the event that the wearer is disabled in a darkened or smoke-filled area and in need of rescue.

Specifically, the present invention is comprised of a safety helmet that includes a molded shell adapted to fit over a user's head, a light attachment bracket on the rear section of the shell; and a battery-powered light that includes an attachment clip adapted for releasable attachment to the light attachment bracket.

More specifically, the safety helmet is comprised of a molded head covering or shell that includes a crown portion to fit over the upper part of the user's head, and a brim that extends outwardly from the lower edge of the crown section. The brim can extend partially or entirely around the crown, and can be of uniform width around the helmet, or the front and/or rear section of the brim can be elongated. The helmet will normally also include an adjustable liner that includes a headband to fit around the user's head and one or more top bands to fit over the user's head, with the ends of the top bands being attached to the headband. An adjustment gear is connected to the headband so that the circumference of the headband can be adjusted.

Two types of mounting brackets are contemplated by the present invention. The bracket may be an attachable bracket that can be attached to the rear section of an existing safety helmet. Alternatively, the bracket can be integrally molded as part of the helmet shell. The attachable mounting bracket may include a first section for use in releasibly attaching a battery-powered light, and a second section for attaching the bracket to the helmet shell outer surface. For example, the bracket may comprise a center clip engaging section with mounting plates on either side of the clip engaging section to secure the clip to the helmet. The clip engaging section is spaced from the shell when the mounting plates are attached to said shell by intermediate spacers extending inwardly from the clip engaging section to the mounting plates. An adhesive, such as double-sided adhesive tape, may be used to attach the mounting plates to the helmet shell. The center clip engaging section is preferably horizontally aligned with parallel, horizontal upper and lower edges.

The alternative integrally molded bracket will also include a clip attachment section that is spaced from the rear of the helmet, and spacers that extend from the attachment section to the rear of the helmet, with the outer and inner ends of the spacers being integrally formed with the attachment section and the rear of the helmet shell, respectively. In addition, the lower edges of the bracket spacers can be integrally molded with the rear of the shell brim.

The battery-powered lights forming a part of the invention are commercially available, and do not per se form a part of the invention. The major components of these lights are a housing, a light emitter, a multi-position control switch, and circuitry to connect the battery, emitter and switch.

The housing includes a transparent front section and an opaque rear section that are joined together to form an interior cavity. The transparent front section is preferably molded of a colored, e.g., orange or red, transparent plastic, that may be shaped to increase light visibility. An attachment clip extends from the rear section. The clip includes a flexible elongated arm that is attached at its top end to the rear section with a spacer. The unattached bottom end of the clip arm includes an inwardly extending locking projection or tang to secure the light to the attachment clip when the arm is inserted onto the bracket and the arm is in an unflexed state. The housing is preferably rectangular. However, other housing shapes, such as round or triangular housings, are also contemplated by the present invention.

The light emitter is preferably one or more light emitting diodes (LEDs) to achieve the maximum light emission with minimum battery drain, thereby prolonging the use of the light between battery replacements. The circuit connecting the light emitter or emitters and the battery may include a flasher circuit of known configuration to determine whether current is provided to the light emitter in a continuous or discontinuous manner, so that the emitter will display continuously, or in a strobe-like manner. A multi-position switch, such as a pushbutton switch, controls the flow of current through the circuit and is used to select between continuous and discontinuous emission.

When the safety helmet is to be worn under low-light conditions, the wearer simply clips the light to the rear of the helmet by inserting the flexible clip arm between the clip attachment section of the bracket and the rear of the helmet, pushing the attachment arm downward until the inwardly extending locking projection is beneath the lower edge of the clip attachment section, thereby securing the light to the helmet. Before entering the low-light area, the wearer turns the multi-position switch to one of the closed positions, so that the light either shines continuously or intermittently, as desired. As a result, when wearing the illuminated helmet, others can easily see the wearer from the rear of the wearer.

DETAILED DESCRIPTION OF THE INVENTION

Figure 1:
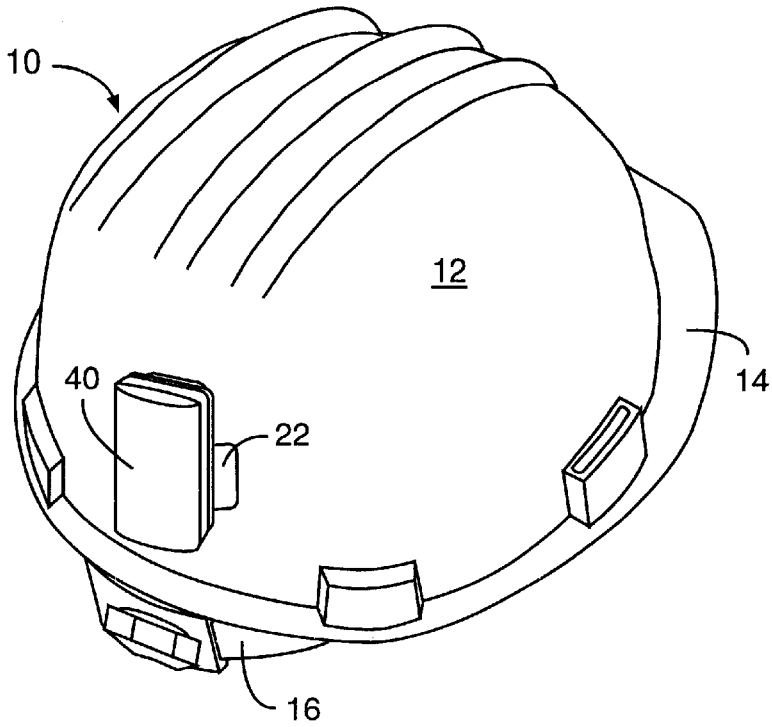
FIG. 1 is a perspective view of an illuminated safety helmet as seen from the rear.

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

An exemplary safety helmet for use with an attachable bracket is comprised of a helmet shell, generally 10, having a crown section 12 with a continuous brim 14 extending from the lower edge of crown 12. An adjustable inner liner 16 is positioned within the interior of shell 10 for mounting the helmet onto the user's head.

Figure 2:
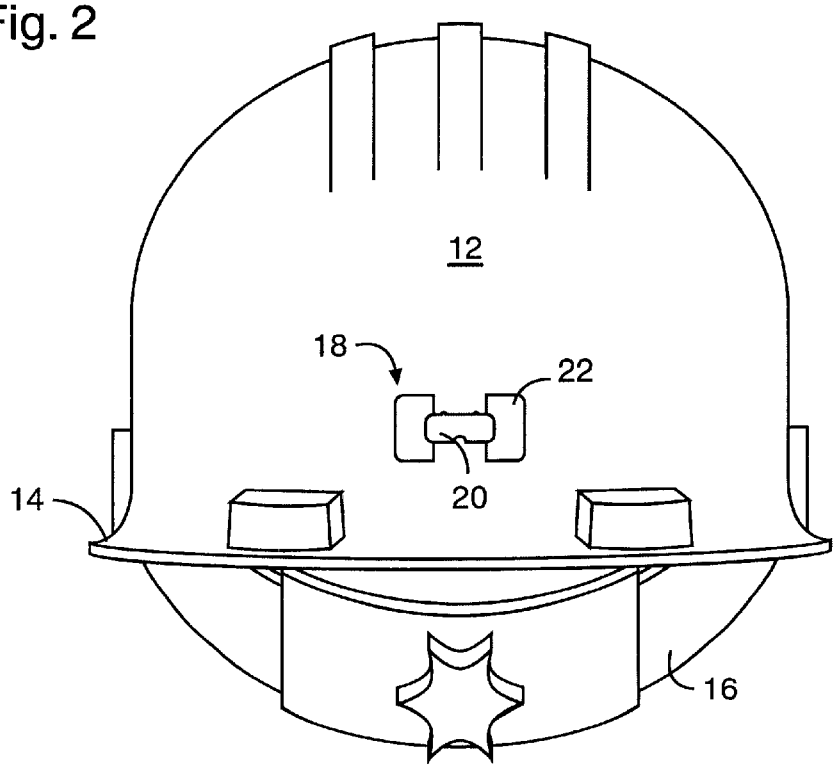
FIG. 2 is a rear view of a safety helmet and an attachable clip mount.
Figure 3:
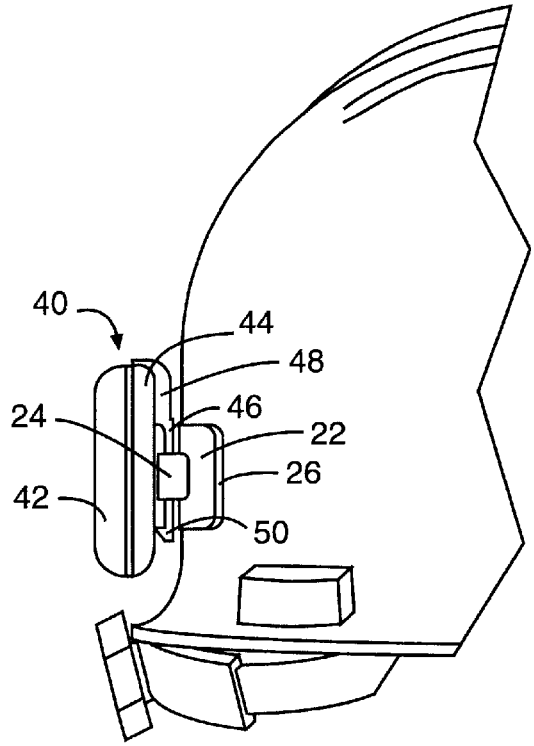
FIG. 3 is a side view of a safety helmet with an attachable clip and a mounted light.

As best illustrated in FIGS. 2 and 3, attachable bracket, generally 18, is comprised of a center clip attachment section 20, outwardly extending mounting plates 22 and connecting spacers 24. Double-sided adhesive tape 26 is used to attach mounting plates 22 to the rear section of shell 10.

Figure 4:
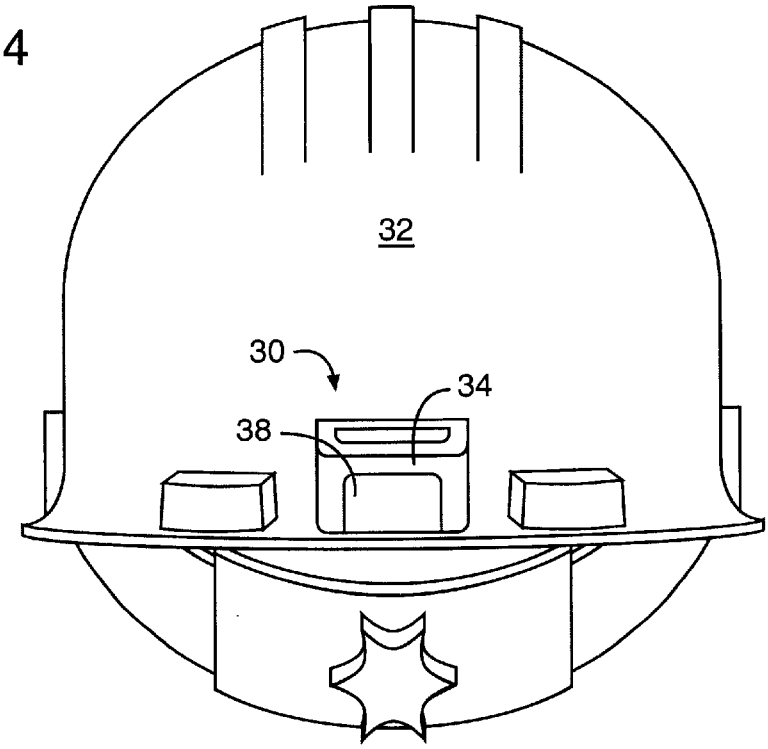
FIG. 4 is a rear view of a safety helmet with an integrally molded clip mount.
Figure 5:
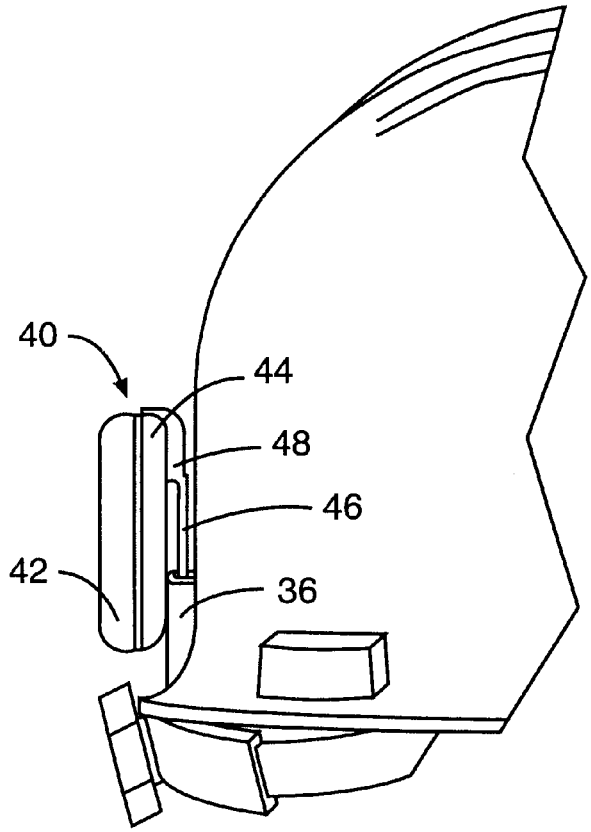
FIG. 5 is a side view of a safety helmet with an integrally molded clip and a mounted light.

In the alternative embodiment shown in FIGS. 4 and 5, attachment bracket, generally 30, is integrally molded with shell 32, and includes a clip mounting section 34 that is generally parallel to, and spaced from, the rear wall of shell 32, and side spacer walls 36 that extend from shell 32 to the outer edges of section 34 to hold section 34 in spaced relationship relative to the rear of shell 32. Clip mounting section 34 includes a tang-engaging lower edge 38 that is parallel to the upper edge of section 34. It will be understood that edge 38 may be in the form of a shoulder that extends only partially across the bottom of section 30.

Battery-powered light, generally 40, attachable to shell 10 with bracket 18, or to shell 32 with bracket 30, is comprised of a transparent, preferably colored, molded plastic front housing section 42 and a rear molded rear housing section 44. Housing section 44 includes a flexible clip arm 46 that is attached at its upper end to section 44 with spacer 48. The lower or distal end of arm 46 includes an inwardly extending locking tang 50 that is adapted to fit beneath the lower edge of section 20 or 34 when light 40 is mounted on the respective bracket. The distance between spacer 48 and tang 50 is approximately equal to the height of section 20 or 34, so that light 40 can be secured to bracket 18 or 30 without significant vertical movement.

Figure 6:
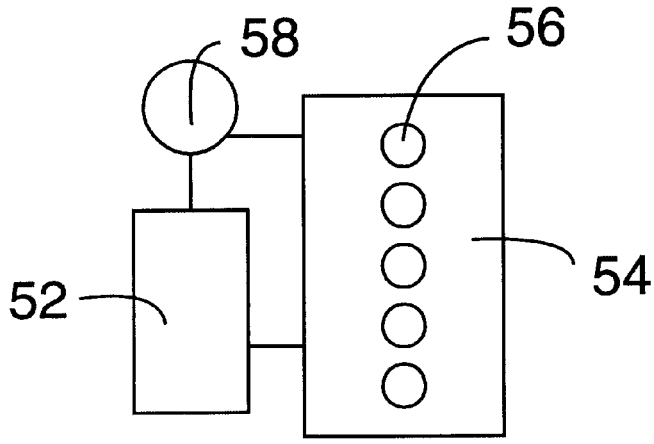
FIG. 6 is a schematic of the circuitry of a battery-powered light.

As best shown in FIG. 6, the circuitry of light 40 includes a battery 52, an emitter circuit 54 of known design, a plurality of LEDs 56, and a multi-position switch 58, that includes an open or off position, and a plurality of closed positions providing continuous or intermittent current to LEDs 56, so that the wearer can cause the LEDS to remain constantly on, or to flash in a desired pattern. Multi-position switch 58 is preferably in the form of a pushbutton switch that extends from the rear of housing section 44 for easy access when light 40 is mounted on shell 10 or 32.

Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. Illuminated protective headgear comprising:

a) a safety helmet including a molded shell adapted to fit over a user's head, said shell having a rear section;

b) a battery-powered LED mounting bracket on the rear section of said shell, said mounting bracket including a clip attachment section spaced from the rear section of said helmet shell; and c) a battery-powered LED including an attachment clip having a flexible clip arm for releasable attachment to said clip attachment section of said LED mounting bracket, wherein said flexible clip arm is insertable between said clip attachment section and the rear section of said helmet shell.

2. The protective headgear of claim 1, wherein said light mounting bracket is integrally molded with said shell.

3. The protective headgear of claim 1, wherein said light mounting bracket includes a center clip engaging section and mounting plates on either side of said clip engaging section, said clip engaging section being spaced from said shell when said mounting plates are attached to said shell.

4. The protective headgear of claim 3, wherein the mounting plates of said light attachment bracket include adhesive members for use in attaching said bracket to said shell.

5. The protective headgear of claim 1, wherein said helmet further includes in adjustable inner liner.

6. Illuminated protective headgear to assist in locating wearers in low-light conditions comprising:

a) a safety helmet including a molded shell adapted to fit over a wearer's head, said shell having a rear section, a brim, and a LED mounting bracket integrally molded with the rear section of said shell adjacent to said brim, said mounting bracket including a clip attachment section spaced from the rear section of said shell; and b) a battery-powered LED including an attachment clip having a flexible clip arm adapted to be secured to said clip attachment section of said LED mounting bracket, wherein said flexible clip arm is insertable between said clip attachment section and the rear section of said helmet shell.

7. The headgear of claim 6, wherein said mounting bracket includes a center section substantially parallel to and spaced from said shell, said center section having outer ends, and side sections extending inwardly from said outer ends into integral engagement with said shell.

8. The headgear of claim 7, wherein said mounting bracket includes lower side edges integral with said brim.

9. The headgear of claim 6, wherein said LED includes circuitry for intermittently supplying power to said LED, whereby said LED can be placed in a flashing mode.

10. The headgear of claim 6, wherein said LED attachment clip is flexible and includes a locking tang to secure said LED to said mounting bracket when said clip is inserted into said bracket and said clip is in an unflexed state.

11. Illuminated protective headgear to assist in locating wearers in low-light conditions comprising:

a) a safety helmet including a molded shell adapted to fit over a wearer's head, said shell having a rear section and a brim;

b) a LED mounting bracket includes a center clip engaging section and mounting plates on either side of said clip engaging section, said clip engaging section being spaced from said shell when said mounting plates are attached to said shell; and c) a battery-powered LED including an attachment clip having a flexible arm with a lower surface that includes a locking tang adapted to secure said LED to said LED mounting bracket.

12. The headgear of claim 11, wherein said LED includes circuitry for intermittently supplying current to said LED, whereby said LED can be placed in a flashing mode.

13. The headgear of claim 11, wherein said LED clip is flexible and includes a tang to secure said LED to said attachment clip when said clip is inserted into said bracket and said clip is in an unflexed state.

14. The protective headgear of claim 11, wherein said helmet further includes in adjustable inner liner.

15. The protective headgear of claim 11, wherein said battery-powered LED further includes a housing enclosing a battery, a multi-position switch, and control circuitry connecting said battery, said LED, and said switch, said multi-position switch having a first position for continuously supplying current to said LED, a second position for intermittently supplying current to said LED, and a third position disconnecting said battery from said LED.

16. The protective headgear of claim 15, wherein said LED includes a plurality of LEDs, and said switch includes a plurality of positions for controlling the intermittent illumination of said LEDs.

* * * * *